US005678720A

United States Patent [19]

Van Melle

[11] Patent Number: 5,678,720

[45] Date of Patent: Oct. 21, 1997

[54] LID FOR DISPOSABLE CONTAINERS OF DIFFERING SIZES

[75] Inventor: Hugh Van Melle, Etobicoke, Canada

[73] Assignee: Amhil Enterprises, Mississauga, Canada

[21] Appl. No.: 549,520

[22] Filed: Oct. 27, 1995

[51] Int. Cl.[6] ..... B65D 51/00

[52] U.S. Cl. ..... 220/287; 215/319; 215/317; 220/306; 220/352

[58] Field of Search ..... 215/317, 319, 215/321; 220/287, 212, 352, 353, 356, 306, 309

[56] References Cited

U.S. PATENT DOCUMENTS

| | | | |
|---|---|---|---|
| Re. 28,720 | 2/1976 | Sedlak | 220/287 X |
| 893,469 | 7/1908 | Essmuller | 215/319 |
| 3,317,069 | 5/1967 | Chin | 215/319 X |
| 3,516,572 | 6/1970 | Davis | 220/306 |
| 3,583,596 | 6/1971 | Brewer | 220/306 |
| 3,606,074 | 9/1971 | Hayes | 220/212 |
| 3,883,036 | 5/1975 | Mahaffy et al. | 220/306 |
| 4,106,660 | 8/1978 | Boyle . | |
| 4,421,244 | 12/1983 | Van Melle | 220/306 |
| 4,566,605 | 1/1986 | Rogers . | |
| 4,934,558 | 6/1990 | Vargas | 220/287 |
| 5,046,632 | 9/1991 | Bordner | 220/276 |

OTHER PUBLICATIONS

Advertising brochure for PROCAP® plastic glassware covers, Dinex International, Inc. (Jan. 1, 1995).

*Primary Examiner*—Allan N. Shoap
*Assistant Examiner*—Robin A. Hylton
*Attorney, Agent, or Firm*—Donald E. Hewson

[57] ABSTRACT

A lid is provided for closing off the open end of one of respective first and second containers, each container a different diameter and having a peripherally disposed bead at its open end. An axially disposed annular inner wall projects downwardly from a central cover portion, and defines a generally circular first annular channel open towards the bottom face of the lid. The upper limit of insertion of the peripherally disposed bead of a first container is defined by a generally planar edge. The wall defining the first annular channel has a radially inwardly extending central portion that forms a first reduced waist portion, which is shaped and dimensioned to retain the peripherally disposed bead of the first container, and also defines the upper limit of insertion of the bead of a second container which has a larger diameter, into a second channel formed in the lid. The second channel is further defined by a radially inwardly extending central portion that forms a second reduced waist portion, which is shaped and dimensioned to retain the peripherally disposed bead of the second container. An annular skirt portion extends downwardly and outwardly at the lower extremity of the lid.

13 Claims, 1 Drawing Sheet

LID FOR DISPOSABLE CONTAINERS OF DIFFERING SIZES

FIELD OF THE INVENTION

This invention relates to disposable lids for containers, and more particularly to disposable lids for disposable containers, most commonly beverage containers. Specifically, this invention relates to dome lids for disposable containers, where the lid may fit one or another of a plurality of containers having differing mouth diameters. The lid of the present invention is intended to be formed using a vacuum thermal forming process, from thin, flexible plastic sheet material, typically polystyrene.

BACKGROUND OF THE INVENTION

Disposable lids for containers that typically receive and retain consumable substances, such as beverage containers, food containers, and the like, are well known. Usually, when such lids are disposable, they are made from an inexpensive, thin, flexible plastic material, such as polystyrene. These lids are most commonly used by fast food outlets, cafeterias, doughnut shops, and so on, to cover hot and cold beverages, and perhaps soups, among other consumables. Typically the containers are also disposable and are commonly made from plastic, styrofoam, or coated cardboard.

The overall basic shape of the lip portion of disposable containers is relatively standard. The lip of a coated cardboard container is formed by having the top end portion of the container rolled several times into a tight spiral that is annularly disposed around the top of the container, while a plastic container or a styrofoam container is molded to have a lip of a desired shape. The size of the mouth of the container is not specifically standardized, however. This lack of size standardization is derived partially through necessity as different size containers, such as small, medium, large, and extra large are necessary; however, another problem exists with respect to the exact sizing of each particular size of container lid. There are different suppliers of disposable containers, with each supplier producing containers according to their own measurements. A container of a specified size—extra large, for instance—from one manufacturer may be of a slightly different size, by perhaps one millimetre or so, than the "same size" container from other manufacturers. A container lid manufacturer may supply container lids to several different end users, each of whom might use containers from any manufacturer. Further, any one end user might obtain containers from more than one supplier. Thus, a supplier of container lids is expected to supply lids that snugly fit onto a specific size of container of a somewhat unpredictable size. In order to do this, it is necessary either that the end user uses a container lid that does not fit as well as it should, which is unacceptable, or alternatively go to the trouble of finding the container lid that fits the best. A container lid supplier may have to go to the trouble of designing and manufacturing a container lid specifically to fit that end user's requirements at that time, which would reduce the potential profit for the supplier and would also cause a long delay in supplying the container lids.

It is an object of the present invention to provide a disposable container lid for use with a specified size of disposable container, which container lid accommodate variations in the specified size of container.

DESCRIPTION OF THE PRIOR ART

U.S. Pat. No. 4,106,660 issued Aug. 15, 1978 to BOYLE, discloses a splash proof drink-through beverage container lid that is configured to close only one size container. The central portion of the lid is shaped and dimensioned at its top surface to receive the bottom portion of a container identical to the one the container lid is mounted on, to help retain that container in a somewhat stable manner, for stacking purposes.

U.S. Pat. No. 5,046,632 issued Sep. 10, 1991 to BORDNER, discloses a closure assembly including a molded lid with multi-mode closure orientations. The molded plastic lid has both a primary and a secondary latching feature. The primary latching feature is configured such that it must be physically altered in some manner in order to permit removal of the lid from the container—in other words, it is a tamper evident lid. The second latching feature permits removable reclosing of the lid onto the container, for repeated access to, and subsequent closing off of, the contents of the container. An annular supporting rib depends from the undersurface of the container lid. While the lid has multi-mode closure configurations, it is configured to close only one size of container. Moreover, the lid is molded—that is, injection molded—and is not capable of being vacuum formed.

A prior art container and dome lid arrangement is one which is commonly used for containing yogurt and granola to be mixed in with the yogurt. The yogurt is typically contained in an opaque polystyrene container that is sealed at its mouth by means of an aluminum foil seal adhered to an upwardly facing portion of a top lip of the container. The clear plastic dome lid has a central cup portion for containing the granola, which cup portion projects upwardly when the dome lid is in place on the container. The central cup portion extends into a first annular lip comprising a generally planar radially extending portion and a peripheral wall portion depending from the generally planar radially extending portion. The downwardly facing surface of the generally planar radially extending portion receives an aluminum foil seal adhered thereto, in order to seal in and thereby retain the granola. The first annular lip extends into a second annular lip comprising a generally planar radially extending portion and a peripheral wall portion depending from the generally planar radially extending portion. The second annular lip of the dome lid is shaped and dimensioned to receive the top lip of the container, with the downwardly facing surface of the generally planar radially extending portion touching the aluminum foil seal on the upwardly facing portion of the top lip. In order to retain the dome lid in place on the container, until purposely removed, a small annular ridge having a minimum diameter slightly smaller than the maximum diameter of the top lip of the container is disposed on the inwardly facing surface of the peripheral wall portion. This dome lid is configured to close only one size of container.

U.S. Pat. No. 4,421,244 issued Dec. 20, 1983 to the present inventor, discloses a lid for beverage containers, having a skin extending downwardly from a cavity that is adapted for seating against the bead of the container. The skirt has a number of outwardly extending projections formed in it, with each of the projections having a substantially rectangular appearance with a vertical face and vertical side walls. The portions of the skirt between the outwardly extending projections extend inwardly to form a discontinuous waist having an undercut which defines a cavity in the waist portion. The cavity is defined by higher and less inwardly extending undercut over the top portion of each of the outwardly extending projections. Beneath the projections and the waist portions between the projections, there extends outwardly and downwardly a lower band portion, below which lower band portion may be a vertically extending wall with an outwardly turned lip at its bottom. The outwardly extending projections permit radially directed expansion of the skirt of the container lid during placement of the lid onto a container.

U.S. Pat. No. 4,566,605 issued Jan. 28, 1986 to ROGERS, and assigned to a common assignee herewith, discloses a plastic lid for large disposable containers of liquids. The lid has a central well surrounded by an annular ridge with a trough disposed around the annular ridge. Two small radially aligned cuts are formed in the lid, one cut in the well and one cut in the trough. When the walls of the ridge are squeezed together, typically by a person's fingers, the cuts elongate towards and across the ridge so as to eventually meet, thus permitting the portion of the lid defined by the cuts to be removed. Liquid may be poured through the resulting tear-out portion. A spout that is radially aligned with the tear-out portion may be included in the lid to facilitate more accurate pouring. The diameter of the well may be such that the bottom portion of another container can be received therein, for stacking purposes. However, this lid is configured to close only one size of container.

U.S. Pat. No. 4,934,558 issued Jun. 19, 1990 to VARGAS discloses a multiple size disposable plastic cup lid. Here, the lid essentially comprises a flat circular disk having a plurality of radial creases or hinges formed in the disk from the center thereof to its circumference. Thus, the lid may folded about various pairs of creases so as to form a cone-shaped configuration having greater or smaller diameters at the circumference so as to fit various sizes of beverage containers and the like. In order that the lid, once formed to fit a particular size of beverage container will retain its developed folded cone-shaped configuration, a series of pre-molded indentations, each having a frusto-triangular cross-section may be formed so that they may compression fit one to another. A series of frusto-pyramidal protrusions may also be molded into the lip of the lid, for the same purpose. Use of the lid is obviously difficult, requiring specific manipulation, without assurance of a reasonable fit to the mouth of the container.

A company known as Dinex International, Inc., of Glastonbury, Conn., is a supplier of plastic glassware covers identified by the trade mark PROCAP. The caps are said to have universal use and fit, being intended for use as dust covers for room glass or as lids for beverage delivery in hotels; and, if the proper sized lid is used, it may fit to a drinking glass more or less in watertight fashion. The lids, which are vacuum formed from clear polystyrene plastic, have the appearance that they may accommodate several diameters of slightly differing sizes. However, they are manufactured and sold in a great number of sizes, reach of which sizes accommodates diameters over a range of 3 millimetres (for example, 81, 82, and 83 millimetres; where the size of the lid is nominally 82 millimetres). Moreover, the PROCAP covers are specifically intended for use with glassware, and are directed to the hospitality industry; and have no retentive inwardly directed continuous or discontinuous waste portion whereby the rolled rim of a paper beverage container or the molded rim of a styrofoam beverage container can be graspingly retained.

SUMMARY OF THE INVENTION

In accordance with one aspect of the present invention, there is provided a container lid for closing off one of different diameter open ends of one of respective first and second containers, each container having a peripherally disposed bead at the open end. The lid has a central covering panel, a generally vertically disposed annular wall projecting downwardly from the central covering panel, and a radially inwardly extending first reduced waist portion formed in the generally vertically disposed annular wall A first annular channel is formed in the generally vertically disposed wall, immediately above the first reduced waist portion. The first reduced waist portion and the first annular channel together define a first generally circular cavity which is shaped and dimensioned to retain the peripherally disposed bead of the first container. A radially inwardly extending second reduced waist portion is disposed in the generally vertically disposed annular wall below the first reduced waist portion, and a second annular channel is disposed immediately above the second waist portion, so as to define a generally circular second cavity which is shaped and dimensioned to retain the peripherally disposed bead of a second container. An annular skirt portion extends downwardly and outwardly from the generally vertically disposed annular wall.

BRIEF DESCRIPTION OF THE DRAWINGS

Embodiments of this invention will now be described by way of example in association with the accompanying drawings in which.

DETAILED DESCRIPTION OF THE PREFERRED EMBODIMENTS

Figure 1:
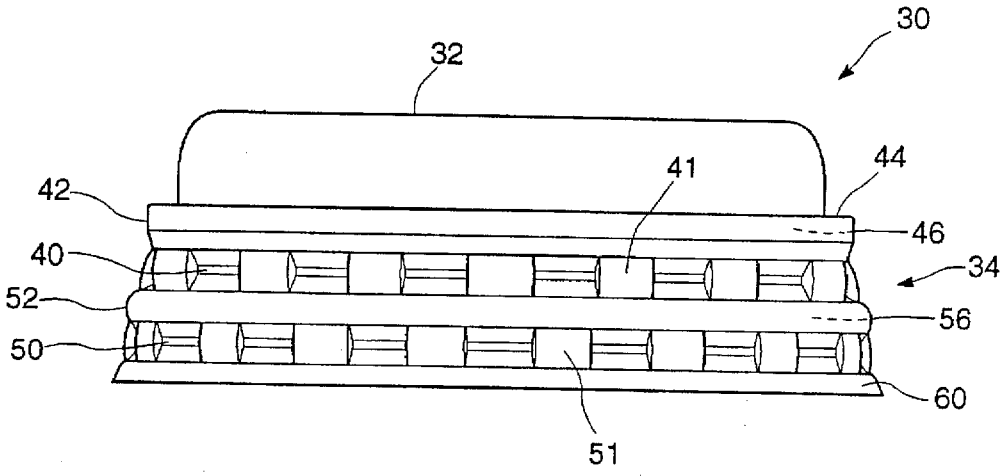
FIG. 1 is a side elevational view of a preferred embodiment of the container lid of the present invention.
Figure 2:
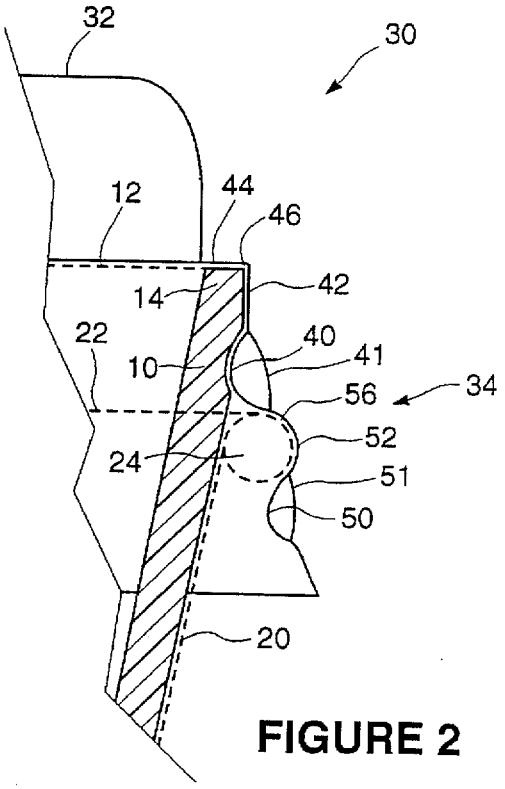
FIG. 2 is an enlarged simplified side sectional view of a portion of the container lid of FIG. 1, with details omitted for the sake of clarity.

Reference will now be made to FIGS. 1 and 2 which show the preferred embodiment of the container lid 30 of the present invention. In the preferred embodiment, the container lid 30 is a dome lid; however, the container lid 30 of the present invention may be any suitable type of disposable lid, as appropriate. In the preferred embodiment, the container lid 30 of the present invention is vacuum formed from a plastic material such as polystyrene, but may be made from other suitable materials also.

The container lid 30 of the present invention is used for closing off the open end of a container, where the open end of one container may be of a slightly different diameter to the open end of another container. In the drawings, a first container 10 having an open end 12, as defined by a peripherally disposed bead 14 at the open end 12, is shown in ghost outline. Further, a second container 20 having an open end 22, defined by a peripherally disposed bead 24 at the open end 22, is also shown in ghost outline. The diameter of the open end 12 of the first container 10 is slightly smaller than the diameter of the open end 22 of the second container 20. The lid 30 will, however, be used only to close off the open end of one or the other of the containers 10 and 12.

The container lid 30 comprises a central covering panel 32, which is shown in the drawings to project upwardly, thereby making the container lid 30 a dome lid. A generally vertically disposed annular wall 34 projects downwardly from the central covering panel 32. An annular skirt portion 60 extends downwardly from the generally vertically disposed annular wall 34, so as to help guide the container lid 30 onto the bead of a container.

A radially inwardly extending first reduced waist portion 40 is formed in the generally vertically disposed annular wall 34. In the preferred embodiment, the first reduced waist portion 40 has regularly intermittently disposed projections 41 along the generally vertically disposed annular wall 34, so as to be discontinuous. In this manner, the first reduced waist portion 40 is slightly expandable so as to thereby permit ready passage of the peripherally disposed bead 14 of the first container 10 therepast.

A first annular channel 42 is formed in the generally vertically disposed annular wall 34 immediately above the first reduced waist portion 40. The first annular channel 42 includes a first generally planar ledge 44 at the top of the first annular channel 42. The first generally planar ledge extends inwardly so as to adjoin to the central covering panel 32. The first generally planar ledge defines the upper limit of insertion of the peripherally disposed bead 14 of the first container 10 into the container lid 30.

The first reduced waist portion 40 and the first annular channel 42, together define a generally circular first cavity 46 that is shaped and dimensioned to receive and retain a peripherally disposed bead 14 of a first container 10.

Further, there is a radially inwardly extending second reduced waist portion 50 disposed in the generally vertically disposed annular wall 34 below the first reduced waist portion 40. In the preferred embodiment, the second reduced waist portion 50 is likewise formed having regularly intermittently projections 51 disposed along the generally vertically disposed annular wall 34, so as to be discontinuous. In this manner, the second reduced waist portion 50 is slightly expandable so as to thereby permit ready passage of the peripherally disposed bead 24 of the second container 20 therepast. A second annular channel 52 is disposed in the generally vertically disposed annular wall immediately above the second reduced waist portion 50. The second reduced waist portion 50 and the second annular channel 52 together define a generally circular second cavity 56 that is shaped and dimensioned to receive and retain a peripherally disposed bead 24 of a second container 20. It can be seen that the generally circular second cavity 56 is larger in diameter than the generally circular first cavity 46. It will also be seen that the radially inwardly extending first reduced waist portion 40 is juxtaposed the second annular channel 52. The inwardly extending first reduced waist portion thereby defines the upper limit of insertion of the peripherally disposed bead 24 of a second container 20 into the container lid 30.

In use, the container lid 30 is placed onto a container in such a manner that the container is, in effect, inserted into the container lid 30 past the annular skirt portion 60. The container lid 30 is continued to be pushed downwardly onto the container. For a container having a peripherally disposed bead approximately the same size of the peripherally disposed bead 24 of a second container 20, the container lid 30 can be pushed downwardly onto the peripherally disposed bead of the container until the peripherally disposed bead enters into the second annular channel 52. The peripherally disposed bead is thereby snugly retained in the generally circular second cavity 56—that is to say that it would be quite difficult to push the container lid 30 farther down onto the container. As discussed above, the first reduced waist portion 40 thereby defines the upper limit of insertion of the peripherally disposed bead of the container into the container lid 30. For a container having a peripherally disposed bead approximately the same size as the peripherally disposed bead 14 of the first container 10, then the container lid 30 can be pushed downwardly onto the bead of the container such that the peripherally disposed bead goes past the second annular channel 52, passes the radially extending first reduced waist portion 40, and ultimately enters into the first annular channel 42. The peripherally disposed bead is thereby snugly retained in the generally circular first cavity 46. The container lid 30 could not be pushed farther down onto the container. As discussed above, the first generally planar ledge 44 at the top of the first annular channel 42 defines the upper limit of insertion of the bead of a container this size.

Figure 3:
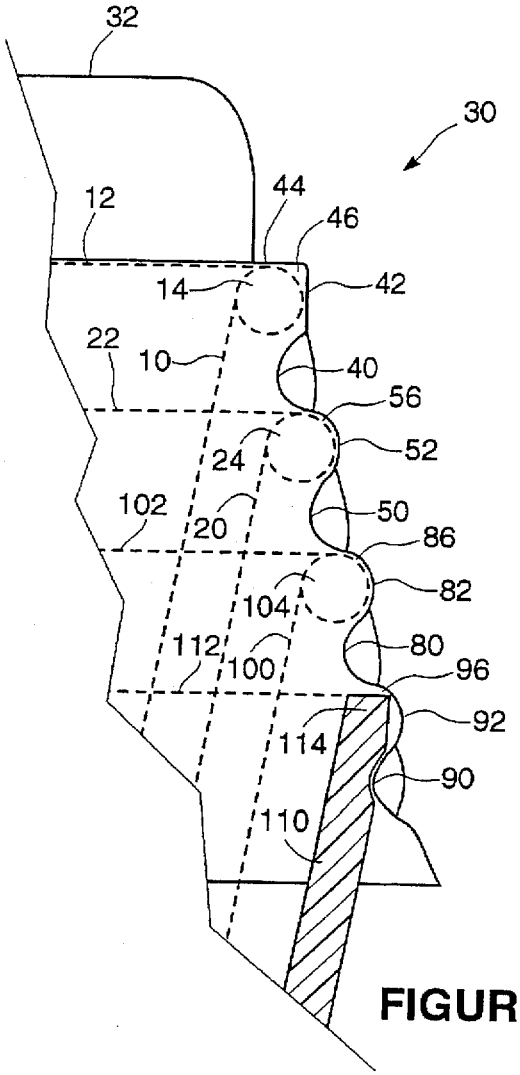
FIG. 3 is an enlarged simplified side sectional view, similar to FIG. 2, with details omitted for the sake of clarity, of an alterative embodiment of the container lid of the present invention.

In an alternative embodiment, as shown in FIG. 3, it is contemplated that the container lid 70 of the present invention could be made to accommodate containers of several different sizes, with each size being slightly different one from the next. The container lid 70 is similar to the preferred embodiment container lid 30, as discussed above, and further comprises a radially inwardly extending third reduced waist portion 80 disposed in the generally vertically disposed annular wall 74 below the second reduced waist portion 50. A third annular channel 82 is disposed in the generally vertically disposed annular wall 74 immediately above the third reduced waist portion 70. The third reduced waist portion 80 and the third annular channel 82 together define a generally circular third cavity 86 shaped and dimensioned to receive and retain the peripherally disposed bead 104 defining the open end 102 of a third container 100, of which the peripherally disposed bead 104 is of a slightly larger diameter than the peripherally disposed bead 24 of the second container 20. The container lid 70 further comprises a radially inwardly extending fourth reduced waist portion 90 disposed in the generally vertically disposed annular wall 74 below the third reduced waist portion 80. A fourth annular channel 92 is disposed in the generally vertically disposed annular wall 74 immediately above the fourth reduced waist portion 90. The fourth reduced waist portion 90 and the fourth annular channel 92 together define a generally circular fourth cavity 96 shaped and dimensioned to receive and retain the peripherally disposed bead 114 defining the open end of a fourth container 110, of which the peripherally disposed bead 114 is of a slightly larger diameter than the peripherally disposed bead of the third container 100.

It will be noted that, for the sake of illustration, containers 10 and 110 are considered to be styrofoam cups, whereas containers 20 and 100 may be typical rolled paper beverage containers. However in FIG. 3, container 10 may also be rolled paper beverage container.

Other modifications and alterations may be used in the design and manufacture of the apparatus of the present invention without departing from the spirit and scope of the accompanying claims.

What is claimed is:

1. A container lid for closing off one of different diameter open ends of one of a first container and a second container, wherein each container has a peripherally disposed bead at its open end, said lid comprising:

a central covering panel;

an axially disposed annular wall projecting downwardly from said central covering panel;

a radially inwardly extending first reduced waist portion formed in said axially disposed annular wall;

a first annular channel formed in said axially disposed annular wall immediately above said first reduced waist portion;

a first planar ledge extending inwardly radially at the top of said first annular channel, and adjoining said central covering panel;

wherein said first reduced waist portion and said first annular channel together define a circular first cavity shaped and dimensioned to receive and retain said peripherally disposed bead of a first container;

wherein said first planar ledge defines the upper limit of insertion of the peripherally disposed bead of a first container into said container lid;

a radially inwardly extending second reduced waist portion disposed in said axially disposed annular wall below said first reduced waist portion;

a second annular channel disposed in said axially disposed annular wall immediately above said second reduced waist portion;

wherein said second reduced waist portion and said second annular channel together define a circular second cavity shaped and dimensioned to receive and retain a peripherally disposed bead of a second container; and an annular skirt portion extending downwardly and outwardly from said axially disposed annular wall.

2. The container lid of claim 1, wherein said radially inwardly extending first reduced waist portion is juxtaposed said second annular channel, and wherein said radially inwardly extending first reduced waist portion thereby defines the upper limit of insertion of the bead of a second container into said container lid.

3. The container lid of claim 1, wherein said first reduced waist portion is discontinuous along said axially disposed annular wall.

4. The container lid of claim 3, wherein said discontinuous first reduced waist portion has a plurality of regularly intermittently disposed projections along said axially disposed annular wall.

5. The container lid of claim 3, wherein said second reduced waist portion is discontinuous along said axially disposed annular wall.

6. The container lid of claim 5, wherein said discontinuous second reduced waist portion has a plurality of regularly intermittently disposed projections along said axially disposed annular wall.

7. The container lid of claim 1, wherein said container lid is vacuum formed from polystyrene.

8. The container lid of claim 1, wherein said container lid is a dome lid.

9. The container lid of claim 1, further comprising a radially inwardly extending third reduced waist portion disposed in said axially disposed annular wall below said second reduced waist portion; wherein a third annular channel is disposed in said axially disposed annular wall immediately above said third reduced waist portion; and wherein said third reduced waist portion and said third annular channel together define a circular third cavity shaped and dimensioned to receive and retain said peripherally disposed bead of a third container.

10. The container lid of claim 9, further comprising a radially inwardly extending fourth reduced waist portion disposed in said axially disposed annular wall below said third reduced waist portion; a fourth annular channel disposed in said axially disposed annular wall immediately above said fourth reduced waist portion; and wherein said fourth reduced waist portion and said fourth annular channel together define a circular fourth cavity shaped and dimensioned to receive and retain said peripherally disposed bead of a fourth container.

11. The container lid of claim 1, wherein said second annular channel includes a second planar ledge at the top of said second annular channel, wherein said second planar ledge extends inwardly so as to adjoin to said first reduced waist portion, whereby said second planar ledge defines the upper limit of insertion of the bead of a second container into said container lid.

12. The container lid of claim 11, wherein said first reduced waist portion is discontinuous along said axially disposed annular wall.

13. The container lid of claim 12, wherein said discontinuous first reduced waist portion has a plurality of regularly intermittently disposed projections along said axially disposed annular wall.

* * * * *